US005469342A

United States Patent [19]

Chien

[11] Patent Number: 5,469,342

[45] Date of Patent: Nov. 21, 1995

[54] LIGHT-STRIP APPARATUS

[76] Inventor: Tseng L. Chien, 8th Fl.-6, No. 9, San Min Rd., Taipei, Taiwan

[21] Appl. No.: 186,291

[22] Filed: Jan. 25, 1994

[51] Int. Cl.[6] ..... F21V 9/16

[52] U.S. Cl. ..... 362/84; 362/103; 362/189; 224/253; 224/902

[58] Field of Search ..... 362/84, 157, 189, 362/103, 108, 251; 224/253, 902; 313/498, 503, 504

[56] References Cited

U.S. PATENT DOCUMENTS

| | | | |
|---|---|---|---|
| 3,788,737 | 1/1974 | Kidd | 362/84 |
| 3,944,803 | 3/1976 | Chao | 362/108 |
| 4,853,327 | 8/1989 | Dattagupta | 362/24 |
| 4,895,110 | 1/1990 | LoCascio | 362/108 |
| 5,245,516 | 9/1993 | de Haas et al. | 362/84 |
| 5,245,517 | 9/1993 | Fenton | 362/84 |

FOREIGN PATENT DOCUMENTS

| | | | |
|---|---|---|---|
| 335795 | 5/1972 | U.S.S.R. | 362/84 |

*Primary Examiner*—James C. Yeung
*Assistant Examiner*—Sara S. Raab
*Attorney, Agent, or Firm*—Omri M. Behr; Matthew J. McDonald

[57] ABSTRACT

A light-strip apparatus including a flexible lower strip, a transparent flexible upper strip detachably engaged to the lower strip thus together forming a sheath, an elongated flexible light-emitting device being received in the sheath for emitting light, and a power box attached to a substantially central portion of the flexible light-emitting device for providing AC power to enable the flexible light-emitting device to flash. The flexible light-emitting device has a plurality of spots sequentially connected by interconnected lines and the spots and the lines will flash if the light-emitting device is electrified by the power box.

8 Claims, 9 Drawing Sheets

LIGHT-STRIP APPARATUS

FIELD OF THE INVENTION

The present invention relates to a light-strip apparatus particularly one which is capable of emitting light and is allowed to be fixed on footwear, headgear, traffic cones and so on.

BACKGROUND OF THE INVENTION

Some people such as joggers, street cleaners, road constructors and so on are in danger of being hit by a car or the like in bad weather. Some of the people wear a sleeveless vest with fluorescent material thereon, but on a dark, rainy night the vest still may not be easily seen. A light-strip made of LED strings are also provided allowing users to attach the LED light-strip on their clothes or hats for providing better visible effect to other persons such as drivers. However, the LED light-strip is not popular due to poor vision angle of the LEDs. Moreover, the LEDs occupy space and are easily pulled out of the light-strip. It is requisite to provide a light-strip apparatus which provides better vision angle range than the LED light-strip, occupies less space, and is not apt to be damaged by impact or pulling forces.

SUMMARY OF THE INVENTION

It is an object of the present invention to provide a light-strip apparatus including a flexible lower strip, a transparent flexible upper strip detachably engaged to the lower strip thus together forming a sheath, an elongated flexible light-emitting means being received in the sheath for emitting light, and a power box attached to a substantially central portion of the flexible light-emitting means for providing AC power to enable the flexible light-emitting means to flash. The flexible light-emitting means has a plurality of spots sequentially connected by interconnected lines and the spots and the lines will flash if the light-emitting means is electrified by the power box.

DETAILED DESCRIPTION OF THE PREFERRED EMBODIMENTS

Figure 1:
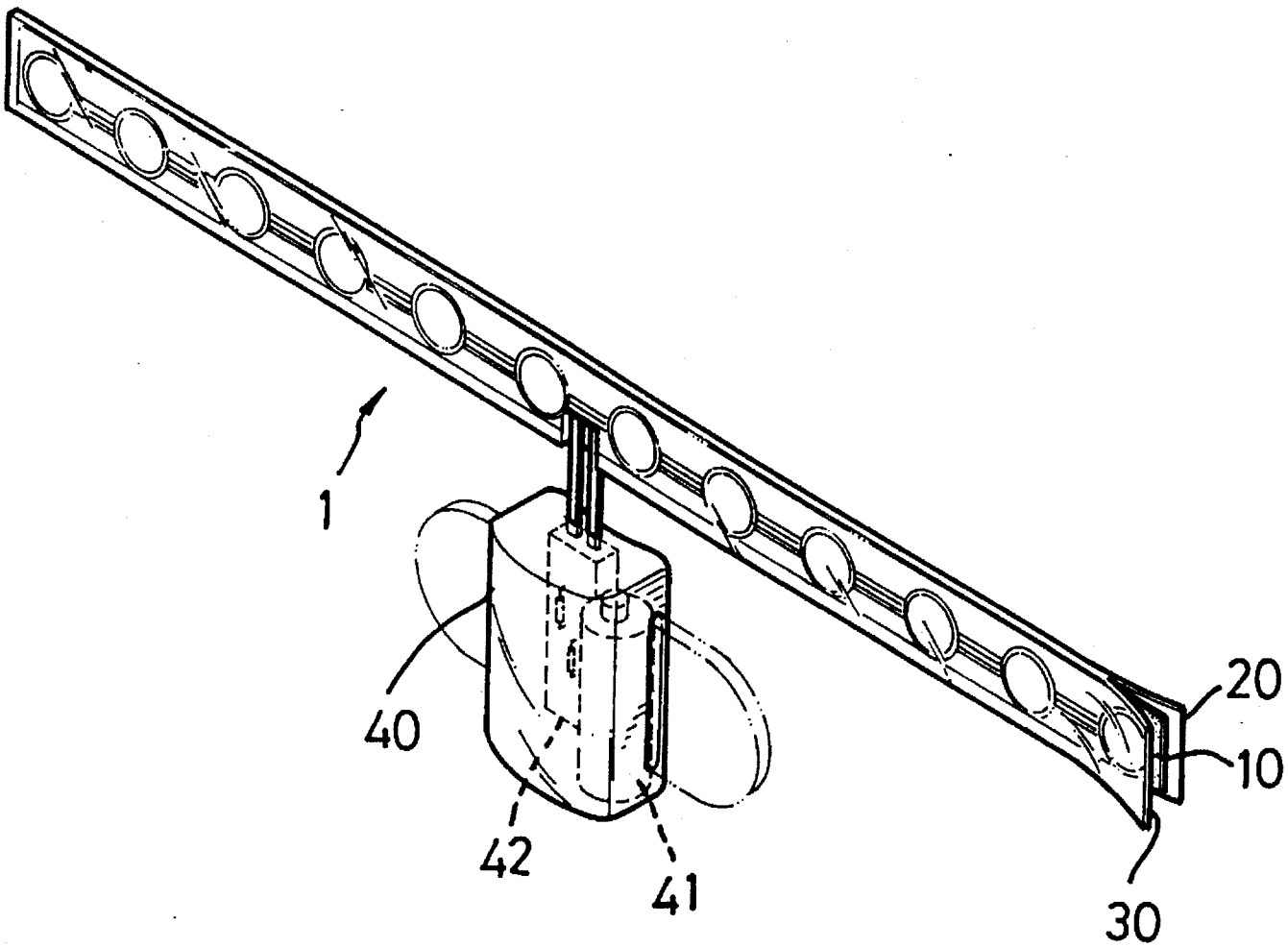
FIG. 1 illustrates a flexible light-strip of the present invention, with one end thereof being stripped off for illustrating different layers of the light-strip.
Figure 9:
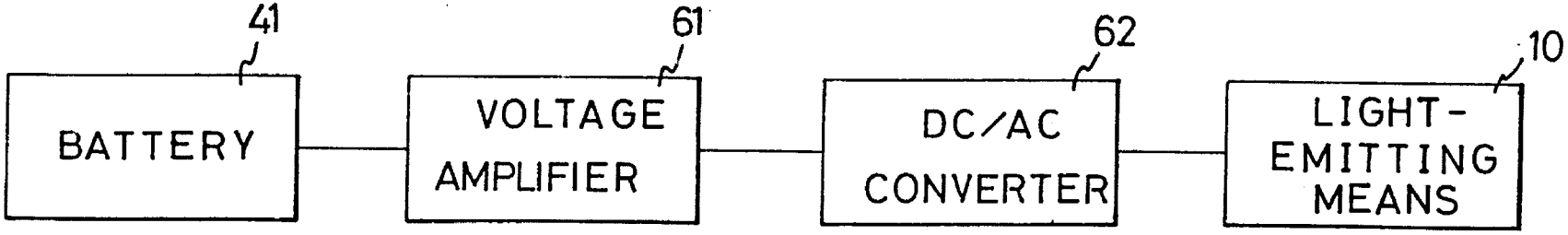
FIG. 9 illustrates a block diagram of a circuit in the power box.
Figure 10:
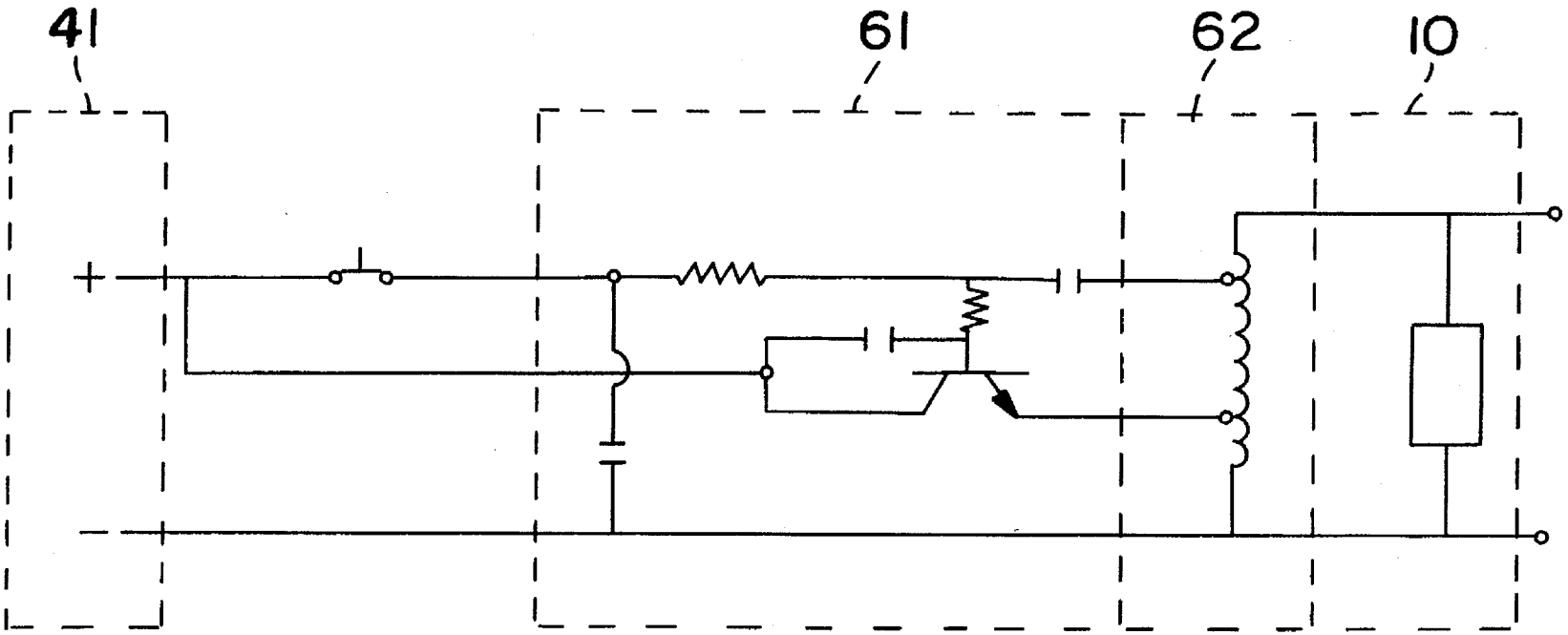
FIG. 10 is a detailed circuit of FIG. 9.

Referring to FIG. 1, a light-strip apparatus 1 in accordance with the present invention comprises a flexible lower strip 20, a transparent flexible upper strip 30, an elongated flexible light emitting means 10, and a power box 40. The flexible lower strip 20 may be made of flexible plastic material. The transparent flexible upper strip 30 is attached to the lower strip 20 by means of heat healing process thus together forming a sheath. The elongated flexible light-emitting means 10 is received in the sheath for emitting light through the transparent flexible upper strip 30. The flexible light-emitting means 10 is an electro-luminescent component (EL) which occupies less space than LEDs and is not apt to be broken by impact or pulling forces. The elongated light-emitting means 10 is electrically connected to the power box 40 which provides AC power to enable the light-emitting means 10 to flash in a predetermined frequency. Actually, the power box 40 comprises a battery 41 and a circuit board 42 installed therein. The circuit board 42 together with the battery 41 constitute a circuit of the power box 40 as shown in FIG. 9. The circuit comprises the battery 41, a DC/AC converter amplifier 61, and a voltage amplifier 62. The battery 41 provides a required DC voltage which is converted to a first AC voltage via the DC/AC converter amplifier 61. The first AC voltage is amplified to a second AC voltage by the voltage amplifier 62 and the second AC voltage is used to enable the light-emitting means 10 to light up. The detail of FIG. 9 is illustrated in FIG. 10 which is well known and not described in detail herein.

Figure 2:
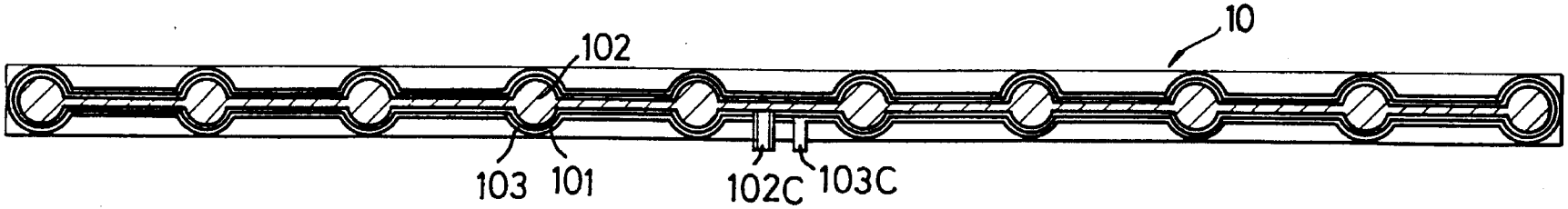
FIG. 2 is a pattern of a light-emitting means of the flexible light-strip as shown in FIG. 1.

Referring to FIG. 2, the elongated light-emitting means 10 basically comprises three layers, where a luciferin layer 101 is sandwiched between a conductive glass layer 102 and a metal layer 103. The conductive glass layer 102 is a NESA™ layer which is available from Pittsburgh Plate Glass Company. The NESA™ layer 102 and the metal layer 103 constitute two electrodes of the light-emitting means 10, each having a contact 102C, 103C, substantially extending from a central point of the corresponding elongated layer allowing them to be electrically connected to the power box 40. The three layers 101, 102, and 103 are fixed in a flexible transparent sheath (not labeled). Luminescent light emits outward from the NESA™ layer 102 if an AC voltage is applied to the two electrode contacts 102C and 103C. The NESA™ layer 102 is formed as a plurality of solid circles sequentially connected by interconnected lines. Each of the solid circles may have a maximum area of 3.8 square centimeters. The luciferin layer 101 has a similar shape as that of the NESA™ layer 102, yet being slightly enlarged. The metal layer 103 also has a similar shape as that of the luciferin layer 101, yet being slightly enlarged. When the two electrode contacts 102C and 103C, are applied with the second AC voltage, luminescent light emits outward through the NESA™ layer 102. Since the overlapping area of the three layers is equivalent to the area of the NESA™ layer 102, the exact luminescent area is equivalent to the area of the NESA™ layer 102. Of course, the shape of the spots of the three layers can be other shapes such as triangles, quadrangles, and so on.

Figure 3B:
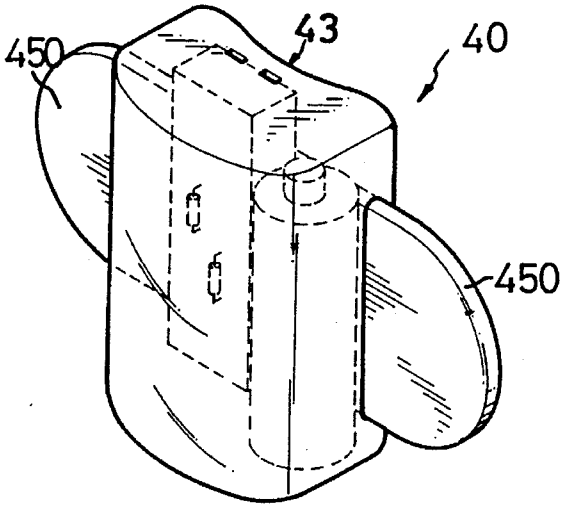
FIG. 3B illustrates the flexible strip is inserted through the power box leaving two wings at two sides of the power box.
Figure 3A:
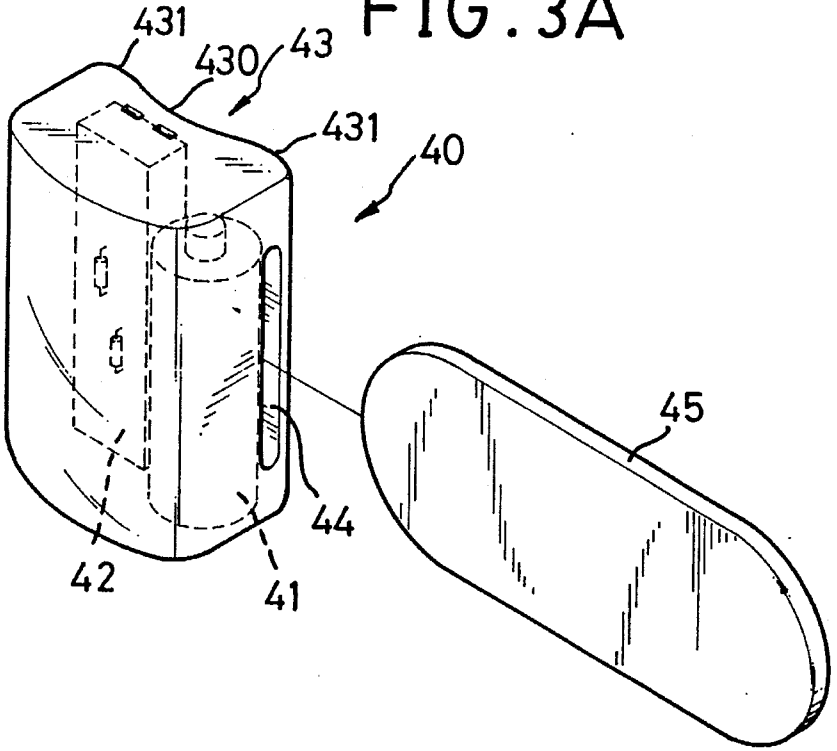
FIG. 3A illustrates a power box and a flexible strip of the flexible light-strip of FIG. 1.

Referring to FIGS. 3A and 3B, the power box 40 has an attaching surface 43 including a concave surface 430 at a central portion thereof and defining two shoulders 431 which are plain surfaces adjacent to the concave surface 430. This attaching surface 43 allows the power box 40 to be attached to an arcuate surface of an object by the concave surface 430 thereof, or to be attached to a plain surface of an object by the two shoulders 431 thereof. There are two slots 44 formed in two side surfaces of the power box 40 and both slots 44 are in alignment with each other. The two slots 44 allow a flexible strip 45 to pass therethrough and two wings 450 extend at each side of the attaching surface 43. The two wings 450 can be sewn on an object such as a glove or a school bag.

Figure 4:
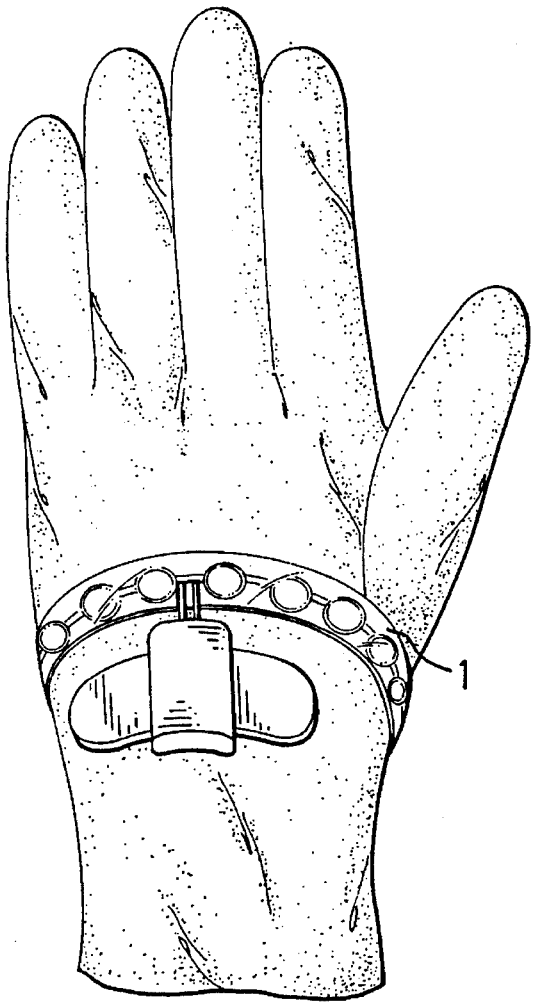
FIG. 4 illustrates the flexible light-strip being fixed on a glove.
Figure 6:
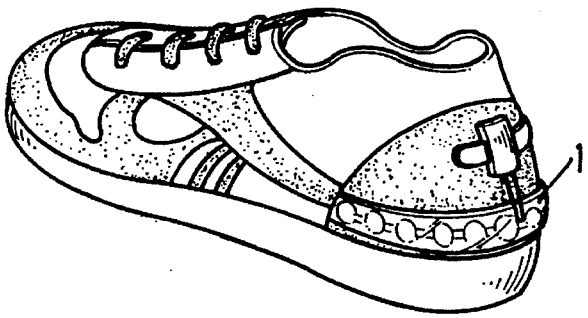
FIG. 6 illustrates the light-strip being fixed on a shoe.
Figure 5:
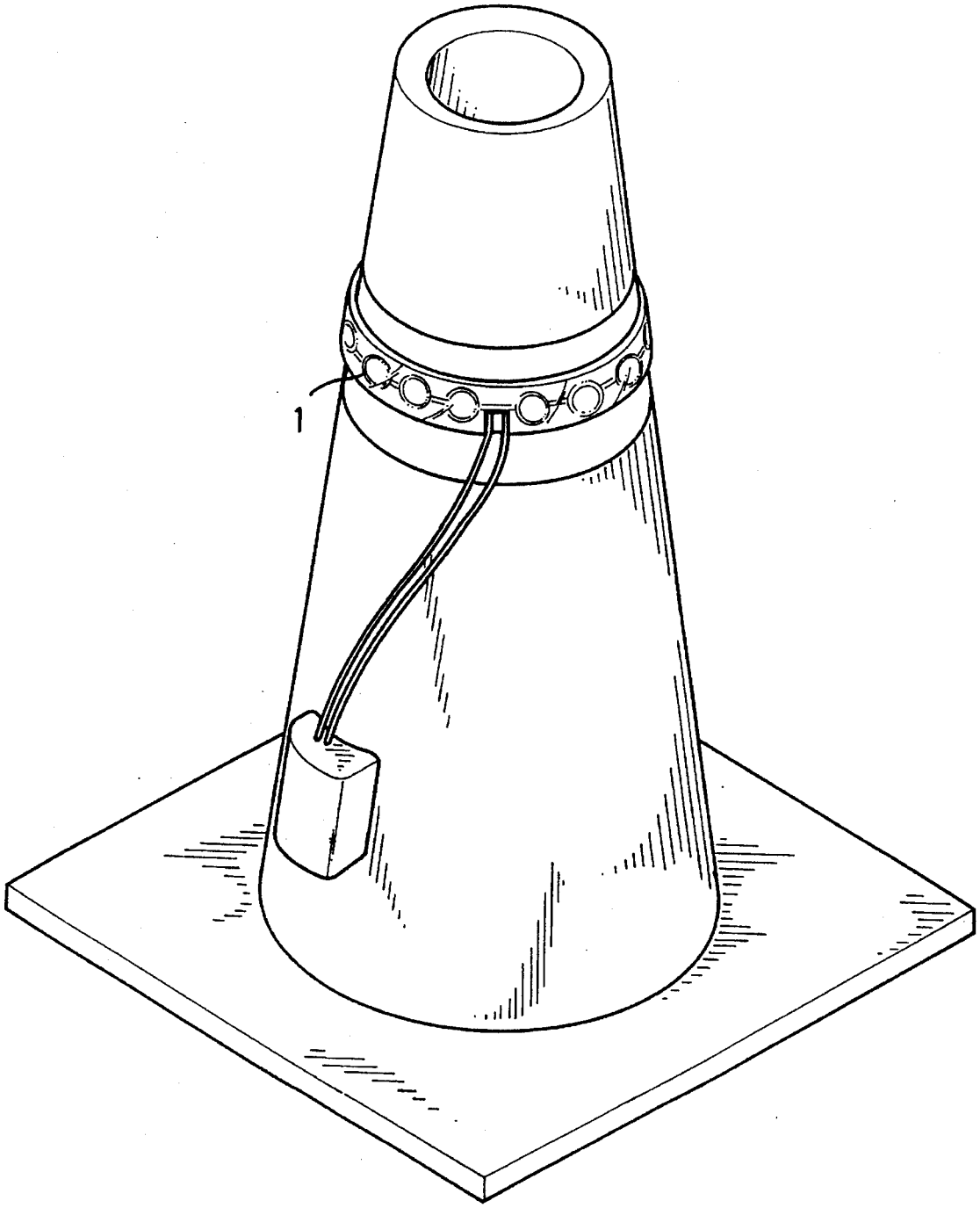
FIG. 5 illustrates the flexible light-strip being fixed on a traffic cone.
Figure 7:
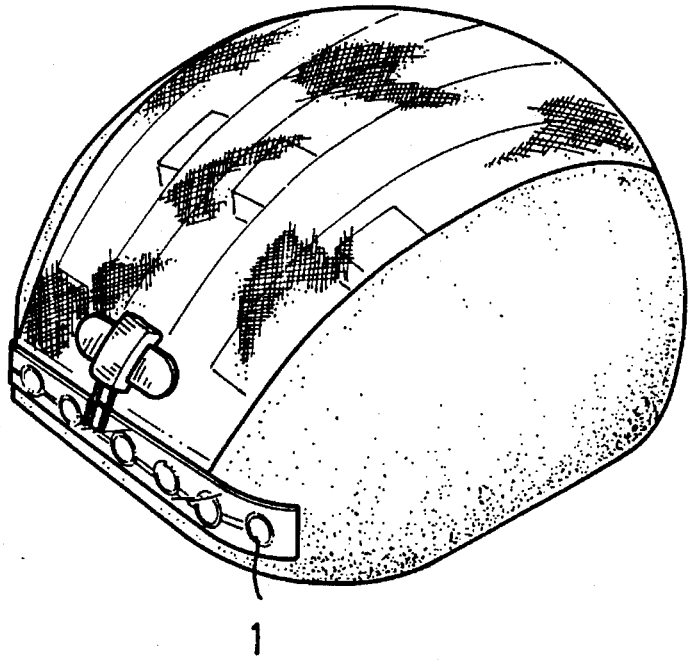
FIG. 7 illustrates the light-strip being fixed on a helmet.
Figure 8:
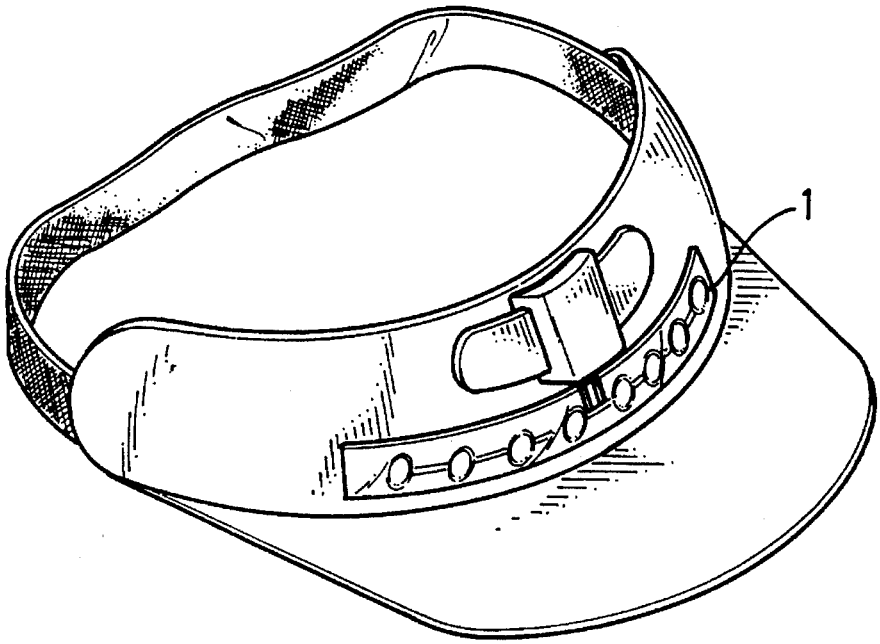
FIG. 8 illustrates the light-strip being fixed on a front portion of a visor.
Figure 11:
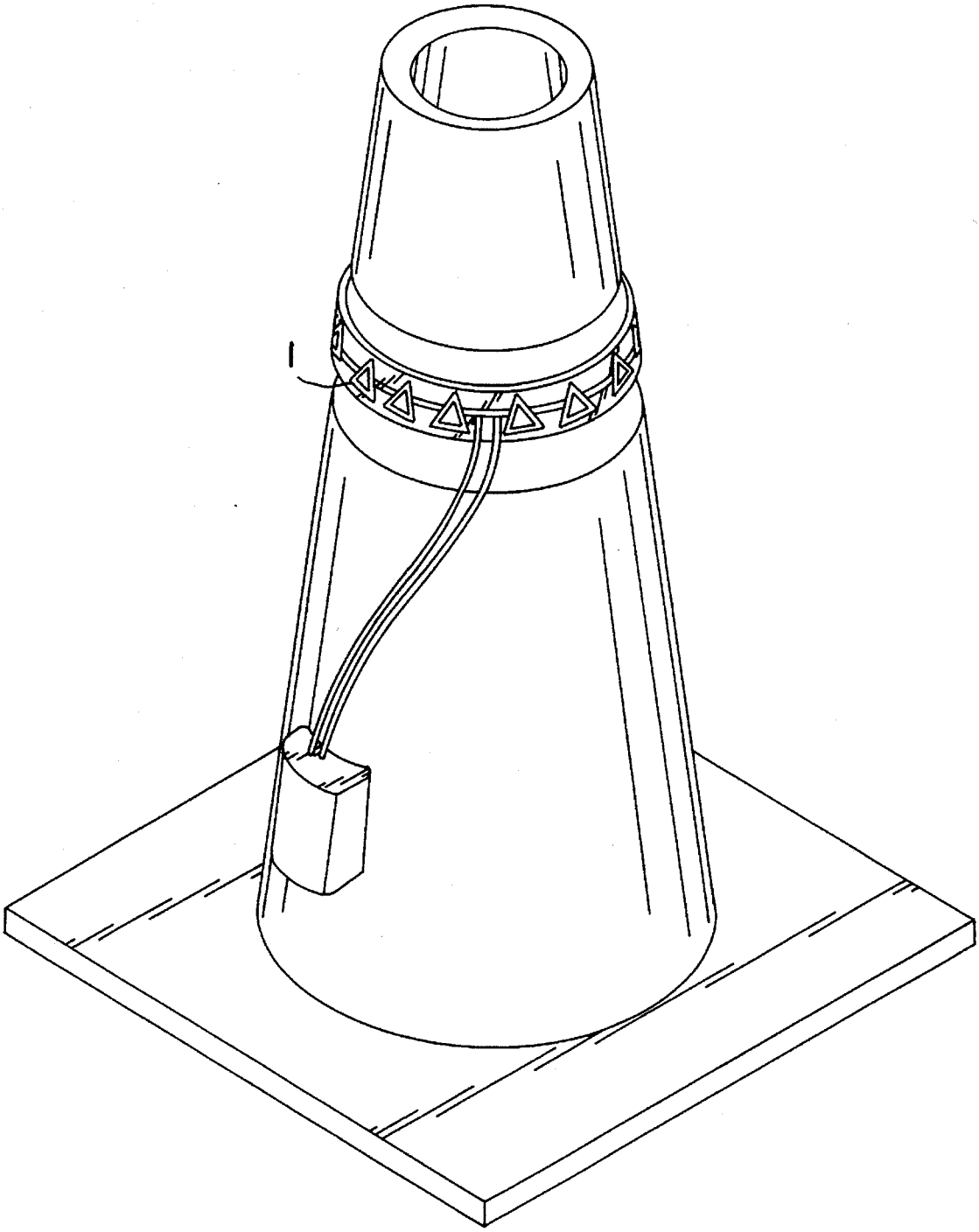
FIG. 11 is an embodiment similar to FIG. 5 except that interconnected solid circles are replaced by interconnected solid triangles.
Figure 12:
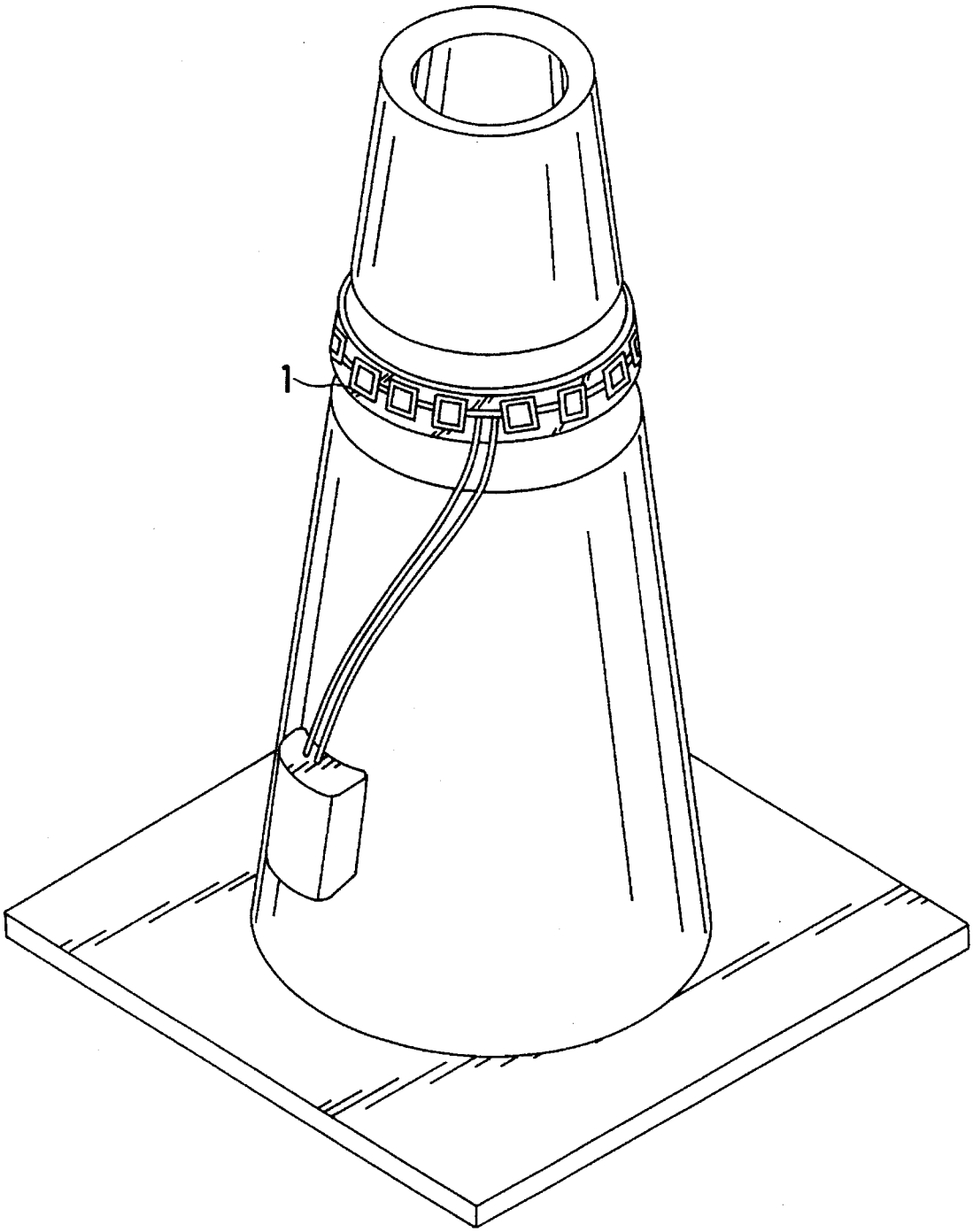
FIG. 12 is an embodiment similar to FIG. 5 except that interconnected solid circles are replaced by interconnected solid quadrangles.

The flexible light-strip as mentioned above can be attached on many daily life objects such as a glove as shown in FIG. 4, a traffic cone as shown in FIGS. 5, 11, or 12 a shoe as shown in FIG. 6, a helmet as shown in FIG. 7, and a visor as shown in FIG. 8. The light-strip can also be attached on other objects such as a visibility belt, a shoulder bag, etc.

Although the invention has been explained in relation to its preferred embodiment, it is to be understood that many other possible modifications and variations can be made without departing the spirit and scope of the invention as hereinafter claimed.

I claim:

1. A light-strip apparatus comprising a flexible lower strip;

a transparent flexible upper strip being detachably engaged to said lower strip thus together forming a sheath; and an elongated interconnected flexible electroluminescent component being received in said sheath for emitting light;

a power box being attached to a substantially central portion of said flexible light-emitting means for providing AC power to enable said flexible light-emitting means to light up;

said power box having an attaching surface including a concave surface at a central portion thereof and two plain surfaces adjacent to said concave surface such that said attaching surface is allowed to be attached to an arcuate surface of an object by said concave surface thereof, or to be attached to a plain surface of an object by said two plain surfaces thereof.

2. The flexible light strip as claimed in claim 1, wherein said power box further comprises two side surfaces adjacent to said attaching surface and each said surface has a slot, said two slots being in alignment with each other and allowing a flexible strip to pass therethrough, with two wings of the flexible strip extending from the two slots.

3. The flexible light strip as claimed in claim 1, wherein said electro-luminescent component is formed as a plurality of interconnected solid circles.

4. The flexible light strip as in claim 3, wherein each said solid circle has a maximum area of 3.8 square centimeters.

5. The flexible light strip as claimed in claim 1, wherein said electro-luminescent component is formed as a plurality of interconnected solid triangles.

6. The flexible light strip as claimed in claim 5, wherein each said solid triangle has a maximum area of 3.8 square centimeters.

7. The flexible light strip as claimed in claim 1, wherein said electro-luminescent component is formed as a plurality of interconnected solid quadrangles.

8. The flexible light strip as claimed in claim 5, wherein each said solid quadrangle has a maximum area of 3.8 square centimeters.

* * * * *